US005961090A

United States Patent [19]

Parkin

[11] Patent Number: 5,961,090

[45] Date of Patent: Oct. 5, 1999

[54] MOUNTING DEVICE

[76] Inventor: Emanuel Parkin, P.O. Box 6069, Dunswart, South Africa, 1508

[21] Appl. No.: 09/052,218

[22] Filed: Mar. 31, 1998

[30] Foreign Application Priority Data

Apr. 3, 1997 [ZA] South Africa ..... 97/2827

[51] Int. Cl.[6] ..... A47F 7/14

[52] U.S. Cl. ..... 248/475.1

[58] Field of Search ..... 248/475.1, 476, 248/488, 489, 495

[56] References Cited

U.S. PATENT DOCUMENTS

| | | | |
|---|---|---|---|
| 4,069,998 | 1/1978 | Rytting | 248/476 |
| 4,228,982 | 10/1980 | Sellera | 248/475.1 X |
| 5,303,895 | 4/1994 | Hart | 248/475.1 |
| 5,667,178 | 9/1997 | Yang | 248/262 |
| 5,749,558 | 5/1998 | Wallo | 248/475.1 |

*Primary Examiner*—Ramon O. Ramirez
*Attorney, Agent, or Firm*—Merchant & Gould

[57] ABSTRACT

The invention provides a mounting device for mounting an article on or against a support structure, for example, a wall, the device including a securing portion and an elongate support portion. The securing portion has one or more securing formation configured to be securable to the support structure. The elongate support portion has one or more support formation extending along its length, at least the one or more support formation is arranged on a plane at an angle to the securing plane of the one or more securing formation, such that, in use, when the securing portion is secured to the supporting structure, the one or more support formation is spaced from the supporting structure over at least a part of the length of the elongate support portion. A complementary locating member is also provided for use with the mounting device.

20 Claims, 2 Drawing Sheets

MOUNTING DEVICE

This application is based on South African patent application serial number 97/2827, filed Apr. 3, 1997, the entire contents of which is incorporated by reference herein.

BACKGROUND OF INVENTION AND PRIOR ART

This invention relates to a mounting device and in particular to a mounting device for mounting an article on a support structure such as a wall.

GENERAL DESCRIPTION OF THE INVENTION

According to the invention there is provided a mounting device for mounting an article on or against a support structure, for example, a wall, the device including:

a securing portion having one or more securing formation configured to be securable to the support structure; and an elongate support portion having one or more support formation extending along its length, at least the one or more support formation being arranged on a plane at an angle to the securing plane of the one or more securing formation, such that, in use, when the securing portion is secured to the supporting structure, the one or more support formation is spaced from the supporting structure over at least a part of the length of the elongate support portion.

Unless the context clearly indicates to the contrary, the word "wall" is to be interpreted to include any substantially upright supporting surface.

The mounting device may have two limbs, defined by the securing and the support portions, being generally bifurcated in sectional profile. In one embodiment, the angle defined between the limbs is greater than 90°.

The support portion may have an elongate rectangular support formation having an elongate edge portion.

The elongate edge portion may have a generally "V"-shaped sectional profile. However, the elongate rectangular support formation may have a generally channel section edge portion. The channel section edge portion may have a generally "L" or "U"- shaped sectional profile, as shown in FIGS. 3 and 4, respectively.

The invention extends to a locating member having an attachment portion which is attachable to the article to be mounted and an engaging portion which is adapted to engage and be carried by the support portion of the mounting device.

The engaging portion may be inclined at an angle relative to the attachment portion, typically at an angle that corresponds to the support portion.

Alternatively, the engaging portion may be in the form of a channel, typically of "L"- or "U"-shaped section which is adapted to be received complementary by the channel defined by the support portion.

The mounting device and the locating member may be made of a material selected from the group consisting of:

a metal, such as aluminium, steel, ferrous alloys, copper, copper alloys, or the like;

a plastics material, such as PVC, polyethylene, melamine, or the like; and a natural material, such as wood, cork, moulded clay, leather, marble, stone, or the like.

The invention extends to a kit for mounting an article on or against a support structure, for example, a wall, the kit including:

a mounting device in accordance with the invention;

a locating member in accordance with the invention; and instructions for securing the mounting device to the support structure, attaching the locating member to the article which is to be mounted on the support structure, and mounting the locating member on the mounting device, thereby mounting the article on or against the support structure.

The kit may further include securing means for securing the mounting device to the support structure. The securing means are typically in the form of wall plugs for location in holes in the support structure and screws sized complementary to the wall plugs. The wall plugs are typically such as those available from Fischer ™.

The invention extends further to a method of mounting an article on a support structure, the method including:

securing an angularily projecting support formation to a wall so that the support formation projects substantially upwardly from the support structure;

attaching an engaging portion complementary to the support formation to the article to be mounted; and locating the engaging portion onto the support formation thereby mounting the article on or against the support structure.

The method may include levelling the support formation on the support structure such that the mounted article is mounted substantially level.

The method may include the step of providing a plurality of holes in the support formation having a diameter larger than that of a shank of a screw which is to be inserted through the hole when securing the support formation to the support structure, such that a degree of play for levelling the support formation on the support structure is achieved.

Embodiments of the invention will now be described by way of example with reference to the accompanying drawings.

DESCRIPTION OF SPECIFIC EXAMPLES

Figure 1:
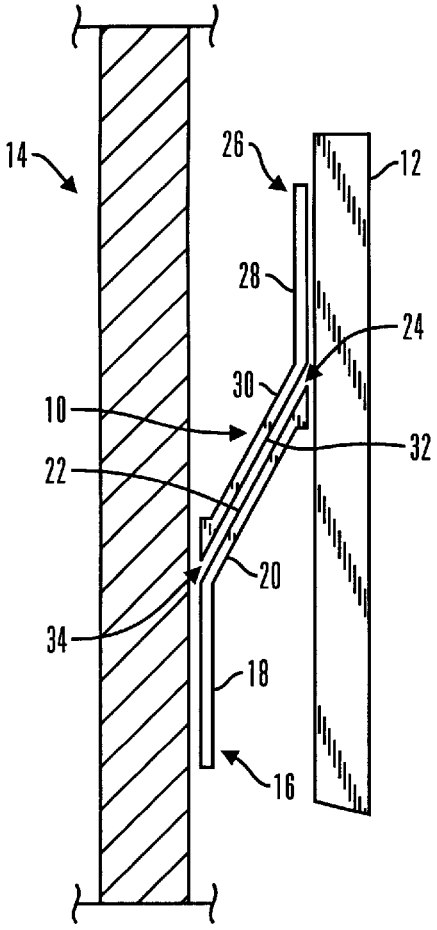
FIG. 1, is a partially sectioned schematic side view, of one embodiment of a mounting device in accordance with the invention.

Referring now to FIG. 1, reference numeral 10 generally depicts a mounting device in accordance with the invention, for mounting a portrait 12 on a wall 14.

The mounting device 10 includes first part 16 comprising a rectangular securing portion 18 that is secured to the wall 14 and a generally rectangular support portion 20 which is inclined at an angle to the securing portion 18 and which defines a rectangular support surface 22 having an elongate edge part 24 of generally "V"-shaped sectional profile. Holes (not shown) are defined in the securing portion 18 through which fixing screws project to secure the first part 16 to the wall 14. The holes are slightly larger than the diameter of the shank of the screw which passes through the hole for easy adjustment and levelling.

The mounting device 10 further includes a second part or locating member 26 of identical form to the first part 16. The locating member 26 has a rectangular attachment portion 28 which is attachable to the portrait 12 by means of screws (not shown) that extend through holes (not shown) defined therein and an engaging portion 30 which is at an angle to the attachment portion 28.

The engaging portion 30 defines a rectangular surface 32 having an elongate edge part 34 of generally "V"-shaped sectional profile. In order to mount the portrait 12 on the wall, the first and second parts 16 and 26 are first secured to the wall 14 and the portrait 12 so that their edge parts 24 and 34 are arranged parallel to a support surface such as a floor and an edge of the portrait 12 respectively. The engaging portion 30 is then mounted on the support portion 20 so that the surfaces 22 and 32 are in complementary abutment with each other, the first part 16 thus carrying the second part 26 and with it the portrait 12 to permit mounting of the portrait 12 on the wall 14. Spacer elements in the form of sponges may be interposed between the wall 14 and a lower edge of the frame of the portrait 12 to enable the portrait 12 to be arranged parallel to the wall 14.

The first and second parts 16 and 26 are extruded from any suitable plastics or metallic material.

Figure 2:
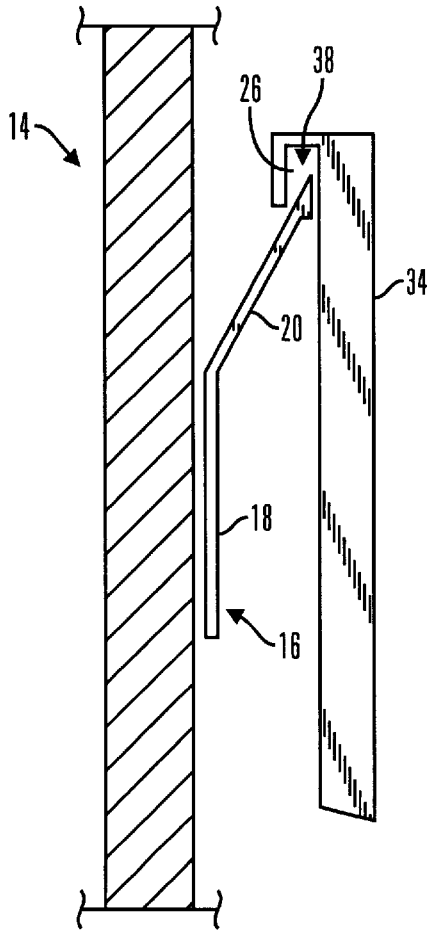
FIG. 2 is a partially sectioned schematic side view, of a second embodiment of a mounting device in accordance with the invention.

FIG. 2 shows a portrait 34 having an overhanging lip 36 which defines a recess 38 that receives the edge part 24 of the first part 16 to permit mounting of the portrait 34 without the use of the second part 26.

Figure 3:
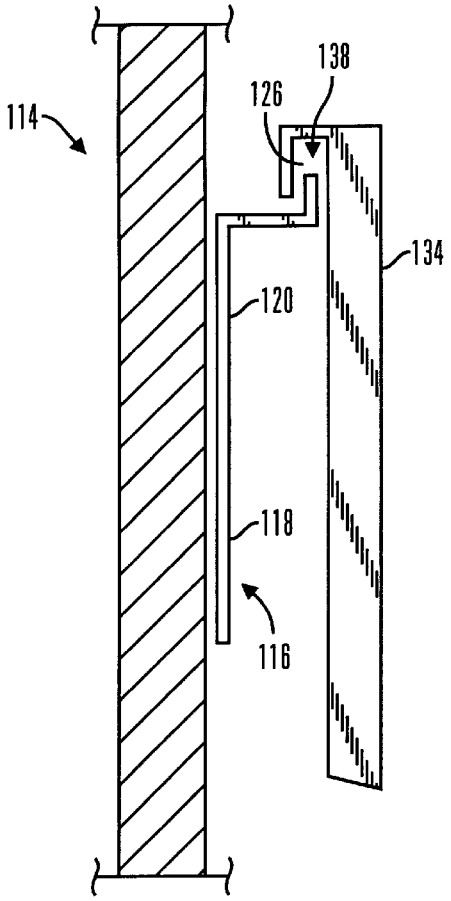
FIG. 3 is a partially sectioned schematic side veiw of another preferred embodiment having an L-shaped sectional profile.

Referring now to FIG. 3, reference numeral 116 generally depicts a mounting device in accordance with the invention, for mounting a portrait 134 on a wall 114.

The mounting device 116 includes a first part 118 comprising a rectangular securing portion 120 that is secured to the wall 114 and a support portion 126 having a generally "L"-shaped sectional profile which is perpendicular to the securing portion 120 and which defines a rectangular support surface having an elongate edge part for supporting the portrait thereon. Holes (not shown) are defined in securing portion 120 through which fixing screws project to secure the first part 118 to the wall 114. The holes are slightly larger than the diameter of the shank of the screw which passes through the hole for easy adjustment and leveling.

The "L"-shaped support portion engages with an overhanging lip of the portrait 134 which defines a recess 138 that receives the edge part of the "L"-shaped support portion 126 of the first part 118, thereby to permit mounting of the portrait 134.

Figure 4:
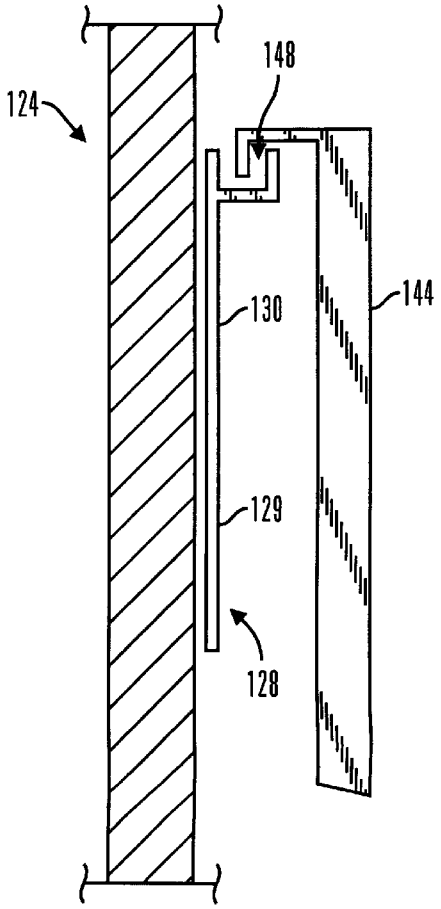
FIG. 4 is a partially sectioned schematic side veiw of another preferred embodiment having an U-shaped sectional profile.

Referring now to FIG. 4, reference numeral 128 generally depicts a mounting device in accordance with the invention, for mounting a portrait 144 on a wall 124.

The mounting device 128 includes a first part 129 comprising a rectangular securing portion 130 that is secured to the wall 124 and a support portion having a generally "U"-shaped sectional profile 148 for supporting the portrait 144 thereon. Holes (not shown) are defined in the securing portion 130 through which fixing screws project to secure the first part 129 to the wall 124. The holes are slightly larger than the diameter of the shank of the screw which passes through the hole for easy adjustment and leveling.

The "U"-shaped support portion 148 engages with an overhanging lip of the portrait 144 which receives the "U"-shaped support portion 148 of the first part 129, thereby to permit mounting of the portrait 144.

The applicant believes that the invention is advantageous in that it facilitates the alignment or levelling of the article should such article be moved inadvertently out of alignment or hang skew.

The invention is not limited to the precise constructional details as hereinbefore described. In particular, a longitudinal recess may be defined in the securing portion for receiving a decorative strip.

The contents of the priority document as well of as the following claims form an integral part of the disclosure of this invention.

I claim:

1. A mounting device for mounting an article on or against a support structure, the device including:

a securing portion having one more securing formation configured to be securable to the support structure; and an elongate support portion having one or more support formation extending along its length, at least the one or more support formation being arranged on a plane at an angle which is at least 90° to the securing plane of the one or more securing formation, such that, in use, when the securing portion is secured to the supporting structure, the one or more support formation is spaced from the supporting structure over at least a part of the length of the elongate support portion.

2. A mounting device as claimed in claim 1, in which the elongate support formation of the support portion has an elongate edge portion.

3. A mounting device as claimed in claim 2, in which the elongate edge portion has a generally "V"-shaped sectional profile.

4. A mounting device as claimed in claim 1, in which the elongate support formation of the support portion has a generally channel section edge portion.

5. A mounting device as claimed in claim 4, in which the channel section edge portion has a generally "L" -shaped sectional profile.

6. A mounting device as claimed in claim 4, in which the channel section edge portion has a generally "U" -shaped sectional profile.

7. A mounting device as claimed in claim 1, which is made of a material selected from the group consisting of a metal, a plastics material and a natural material.

8. A mounting device as claimed in claim 1, which is made of a material selected from the group consisting of aluminium, steel, a ferrous alloy, copper, a copper alloy, brass, bronze, PVC, polyethylene, melamine, wood, cork, moulded clay, leather, marble and stone.

9. A locating member having:

an attachment portion which is attachable to an article to be mounted on a mounting device as claimed in claim 1; and an engaging portion which is adapted to engage and be carried by the support portion of the mounting device.

10. A locating member as claimed in claim 9, in which the engaging portion is inclined at an angle, which is at least 90° relative to the attachment portion.

11. A locating member as claimed in claim 9, in which the engaging portion is inclined at an angle relative to the attachment portion that corresponds to the supplement of the angle defined between the planes of the support portion and the securing portion.

12. A locating member as claimed in claim 9, in which the engaging portion is in the form of a channel.

13. A locating member as claimed in claim 9, in which the engaging portion is in the form of a channel of "L"-shaped sectional profile which is adapted to be received complementarily by the channel defined by the support portion of the mounting device.

14. A locating member as claimed in claim 9, in which the engaging portion is in the form of a channel of "U"-shaped sectional profile which is adapted to be received complementarily by the channel defined by the support portion of the mounting device.

15. A locating member as claimed in claim 9, which is made of a material selected from the group consisting of a metal, a plastics material and a natural material.

16. A kit for mounting an article on or against a support structure, the kit including:

a mounting device as claimed in claim 1;

a locating member having:

an attachment portion which is attachable to an article to be mounted on the mounting device; and an engaging portion which is adapted to engage and be carried by the support portion of the mounting device; and instructions for securing the mounting device to the support structure, attaching the locating member to the article which is to be mounted on the support structure, and mounting the locating member on the mounting device, thereby mounting the article on or against the support structure.

17. A kit as claimed in claim 16, which includes securing means for securing the mounting device to the support structure.

18. A kit as claimed in claim 17, in which the securing means are in the form of wall plugs for location in holes in the support structure and screws sized complementarily to the wall plugs.

19. A method of mounting an article on a support structure, the method including the steps of:

securing a mounting device to a support structure, wherein the mounting device includes:

a securing portion having one more securing formation configured to be securable to the support structure;

an elongate support portion having one or more support formation extending along its length, at least the one or more support formation being arranged on a plane at an angle which is at least 90° to the securing plane of the one or more securing formation, such that, in use, when the securing portion is secured to the supporting structure, the one or more support formation projects substantially upwardly from the support structure;

attaching an engaging portion complementary to the support formation to the article to be mounted; and locating the engaging portion onto the support formation thereby mounting the article or on against the support structure.

20. A method of mounting an article as claimed in claim 19, the method including the additional step of levelling the support formation on the support structure such that the mounted article is mounted substantially level.

* * * * *